US010261446B2

(12) United States Patent
Ogasawara et al.

(10) Patent No.: US 10,261,446 B2
(45) Date of Patent: Apr. 16, 2019

(54) IMAGE FORMING APPARATUS THAT CHANGES A TRANSFER CONTROL PARAMETER FOR DIFFERENT AREAS OF A SHEET

(71) Applicants: KABUSHIKI KAISHA TOSHIBA, Tokyo (JP); TOSHIBA TEC KABUSHIKI KAISHA, Tokyo (JP)

(72) Inventors: Masato Ogasawara, Tokyo (JP); Koichiro Sato, Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/653,528

(22) Filed: Jul. 19, 2017

(65) Prior Publication Data

US 2018/0210375 A1 Jul. 26, 2018

(30) Foreign Application Priority Data

Jan. 25, 2017 (JP) ..... 2017-011351

(51) Int. Cl.
*G03G 15/00* (2006.01)
*G03G 15/16* (2006.01)

(52) U.S. Cl.
CPC ..... *G03G 15/1615* (2013.01); *G03G 15/1675* (2013.01); *G03G 15/5054* (2013.01); *G03G 15/6564* (2013.01); *G03G 15/6591* (2013.01); *G03G 15/6594* (2013.01); *B65H 2407/21* (2013.01); *G03G 2215/00059* (2013.01); *G03G 2215/00075* (2013.01); *G03G 2215/00156* (2013.01)

(58) Field of Classification Search
CPC ..... G03G 15/5054; G03G 2215/00075
See application file for complete search history.

(56) References Cited

U.S. PATENT DOCUMENTS 6,970,663 B2 * 11/2005 Comstock ..... G11C 16/30 399/389
2015/0037053 A1 2/2015 Tsutomu
2016/0236485 A1 * 8/2016 Tossaint ..... B41J 2/01
2016/0282777 A1 * 9/2016 Shibuya ..... G03G 15/2039

FOREIGN PATENT DOCUMENTS

JP H07-248688 A 9/1995
JP 2004-210857 A 7/2004
JP 2007-004066 A 1/2007
JP 2011-197136 A 10/2011

OTHER PUBLICATIONS

Extended European Search Report dated May 23, 2018, filed in counterpart European Patent Application No. 18150765.8 (9 pages).

* cited by examiner

*Primary Examiner* — Victor Verbitsky
(74) *Attorney, Agent, or Firm* — Kim & Stewart LLP

(57) ABSTRACT

An image forming apparatus includes an image transfer unit configured to transfer an image formed on an image carrier to a sheet, according to a transfer control parameter, and a transfer control unit. The transfer unit is configured to set the transfer control parameter to a first value when a first portion of the image is being transferred to a first area of the sheet and to a second value when a second portion of the image is being transferred to a second area of the sheet transfers an image formed on an image carrier to a sheet.

12 Claims, 8 Drawing Sheets

IMAGE FORMING APPARATUS THAT CHANGES A TRANSFER CONTROL PARAMETER FOR DIFFERENT AREAS OF A SHEET

This application is based upon and claims the benefit of priority from Japanese Patent Application No. 2017-011351, filed Jan. 25, 2017, the entire contents of which are incorporated herein by reference.

FIELD

Embodiments described herein relate generally to an image forming apparatus.

BACKGROUND

In the related art, there is a sheet having parts of which physical characteristics such as thicknesses or materials are different from each other in the sheet. In a case of forming an image on such a sheet (hereinafter, referred to as a "hybrid sheet") having a plurality of parts of which the physical characteristics are different from each other as described above, there is a case where image forming quality is reduced because of the non-uniformity. The reason is as described below. In forming the image on the hybrid sheet, an image forming condition is determined according to a condition of a physical characteristics (for example, the thickness and the material) of any of the parts. In this case, there may be a case where the determined image forming condition and an optimal image forming condition for another part do not coincide with each other.

DETAILED DESCRIPTION

Embodiments provide an image forming apparatus that can improve a quality of image formation with respect to a hybrid sheet.

In general, according to one embodiment, an image forming apparatus includes an image transfer unit and a transfer control unit. The transfer unit is configured to set the transfer control parameter to a first value when a first portion of the image is being transferred to a first area of the sheet and to a second value when a second portion of the image is being transferred to a second area of the sheet.

Hereinafter, an image forming apparatus of an embodiment will be described with reference to the drawings.

OVERVIEW

Figure 1:
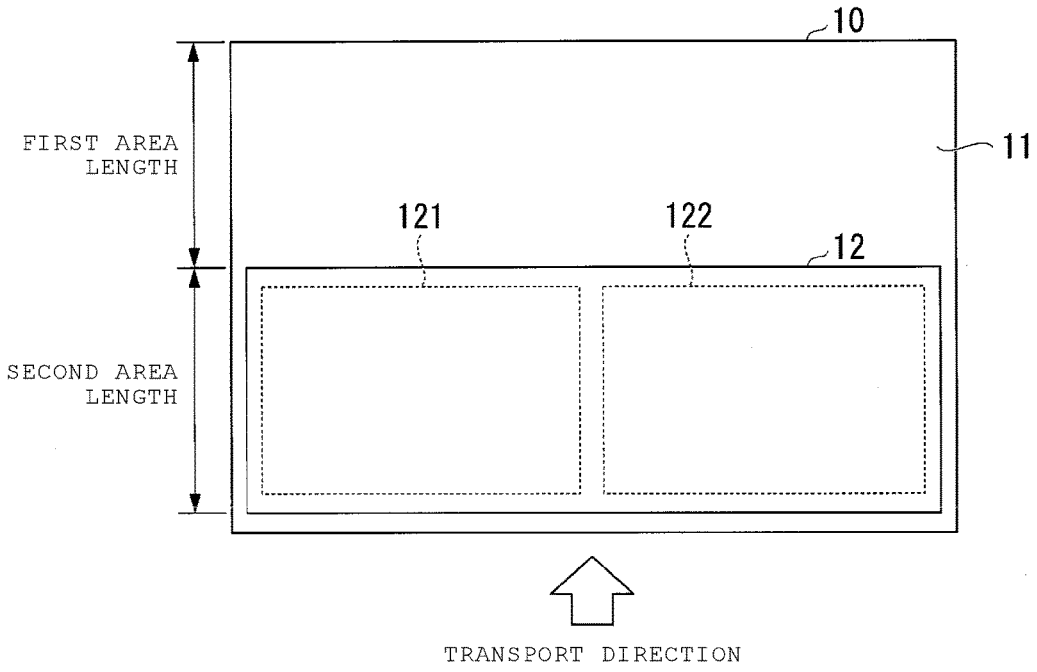
FIG. 1 is a diagram illustrating an example of a hybrid sheet which is an image forming target of an image forming apparatus of an embodiment.

First, an overview of an image forming apparatus of the embodiment will be described. FIG. 1 is a diagram illustrating an example of a hybrid sheet 10 which is subjected to an image forming process performed by the image forming apparatus of the embodiment. The hybrid sheet 10 has a plurality of parts of which the physical characteristics are different from each other. In the example shown in FIG. 1, the hybrid sheet 10 includes a part in a first area 11 having a first physical characteristics and a part in a second area 12 having a second physical characteristics. The first area 11 is a part formed of a plain paper. The second area 12 is a part on which a seal 121 and a seal 122 provided by applying resin coating on the plain paper are formed. When using the sheet, the seal 121 and the seal 122 on the second area 12 can be peeled off.

In the first area 11, an image is formed on the material of the plain paper. In the second area 12, an image is formed on the material of the resin coating. Therefore, in the first area 11 and the second area 12, the materials of the target parts which are subjected to the image forming process are different from each other. In addition, the second area 12 formed of the plain paper, adhesive layers of seal and resin coatings while the first area 11 is formed of only the plain paper. Therefore, in the first area 11 and the second area 12, the thicknesses of the parts which are subjected to the image forming process are different from each other. In the example shown in FIG. 1, the thickness of the first area 11 is smaller than that of the second area 12.

In the image forming apparatus of the embodiment, the hybrid sheet 10 is conveyed in a direction in which the first area 11 and the second area 12 are arranged as shown in FIG. 1, and the image forming process is performed on the hybrid sheet 10. In the example in FIG. 1, the hybrid sheet 10 is conveyed so that the image forming process is performed on the first area 11 prior to the second area 12. A length of the first area 11 in a conveying direction may be referred to as a first area length, and a length of the second area 12 in the conveying direction may be referred to as a second area length.

DETAILS

Figure 2:
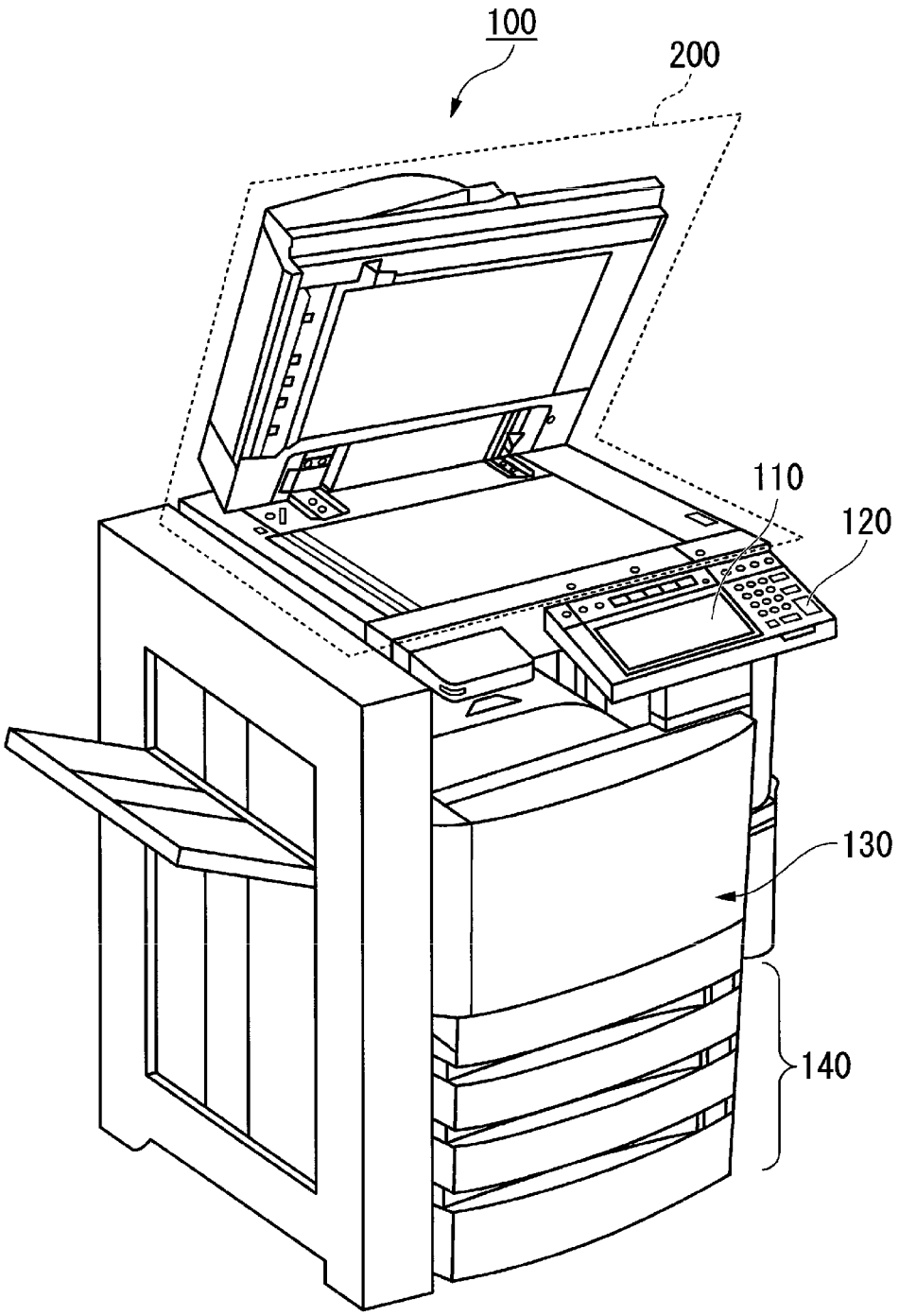
FIG. 2 is an external diagram illustrating an overall configuration example of an image forming apparatus of the embodiment.

Next, details of the image forming apparatus of the embodiment will be described. FIG. 2 is an external perspective view of an overall configuration example of an image forming apparatus 100 of the embodiment. The image forming apparatus 100 is, for example, a multifunction machine. The image forming apparatus 100 includes a display 110, a control panel 120, a printer unit 130, a sheet accommodation unit 140, and an image reading unit 200.

The image forming apparatus 100 forms an image on a sheet using a developer such as toner. The sheet is, for example, a piece of paper or a piece of label paper. Anything can be used as the sheet as long as the image forming apparatus 100 can form an image thereon. Sheets on which the image forming apparatus 100 can form images include the hybrid sheet 10 described above.

The display 110 is an image displaying device such as a liquid crystal display or an organic electroluminescence (EL) display. The display 110 displays various information items relating to the image forming apparatus 100.

The control panel 120 includes a plurality of buttons. The control panel 120 receives user's operation inputs. The control panel 120 outputs a signal according to the operation inputs performed by the user to a control unit (control unit 70 described below) of the image forming apparatus 100. The display 110 and the control panel 120 may be integrally configured as an touch panel display.

The printer unit 130 forms an image on the sheet based on image information generated by the image reading unit 200 or image information received via a communication network. The printer unit 130 forms the image, for example, by performing processing described below. An image forming unit of the printer unit 130 forms an electrostatic latent image on a photosensitive drum (an image carrier) based on the image information. The image forming unit of the printer unit 130 forms a visible image by attaching a developer to the electrostatic latent image. A specific example of the developer is toner. A transfer unit (a transfer unit 20 described below) of the printer unit 130 transfers the visible image (toner image) onto the sheet. A fixing unit (a fixing unit 40 described below) of the printer unit 130 fixes the visible image on the sheet by heating and pressurizing the sheet. The sheet which is subjected to the image forming process may be a sheet accommodated in the sheet accommodation unit 140 or may be a manually fed sheet.

The sheet accommodation unit 140 accommodates sheets used for image forming process in the printer unit 130.

The image reading unit 200 reads the image information of a read target as light brightness and darkness. The image reading unit 200 stores the read image information. The stored image information may be transmitted to another information processing device via a network. The stored image information may be formed on the sheet as an image by the printer unit 130.

Figure 3:
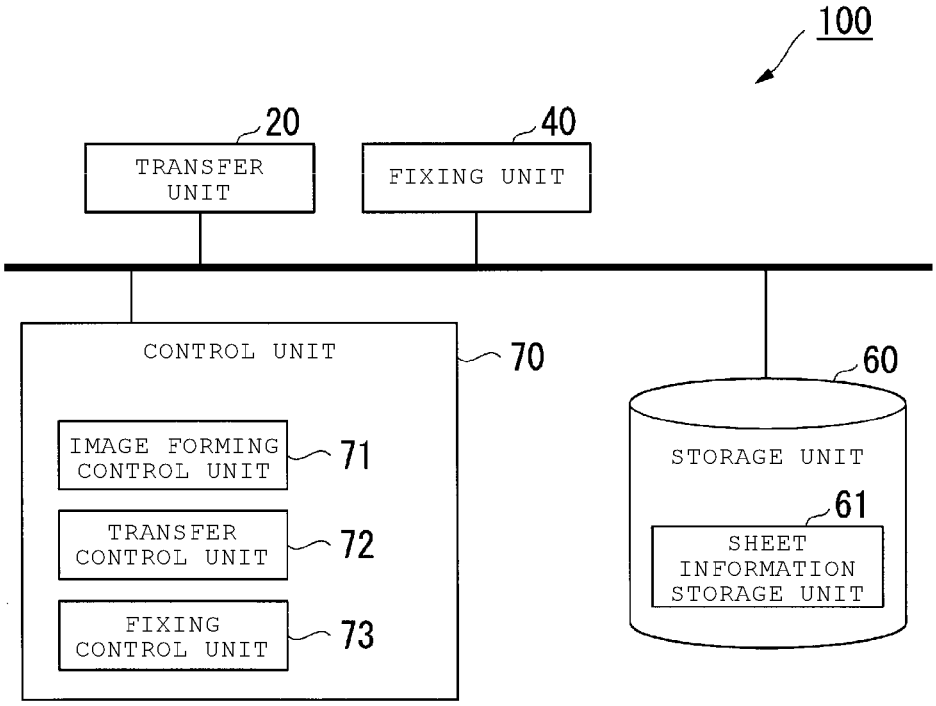
FIG. 3 is a block diagram illustrating a functional configuration relating to image forming processing by the image forming apparatus of the embodiment.

FIG. 3 is a block diagram illustrating a functional configuration relating to the image forming processing by the image forming apparatus 100 of the embodiment. The image forming apparatus 100 includes the transfer unit 20, the fixing unit 40, a storage unit 60, and the control unit 70. The transfer unit 20 forms the electrostatic latent image on the photosensitive drum based on the image information which is an image forming target. The transfer unit 20 forms the visible image by attaching developer on the electrostatic latent image. The transfer unit 20 transfers the visible image onto the sheet according to transfer conditions instructed by the control unit 70. Transferring the visible image (toner image) on the photosensitive drum to an endless transfer belt (hereinafter, referred to as "transfer belt") is referred to as a primary transfer. In addition, transferring the visible image on the transfer belt to the sheet is referred to as secondary transfer. Hereinafter, a case of being merely described as a transfer indicates the secondary transfer. In addition, either a direct transfer method or an indirect transfer method may be applied to the transfer unit 20 of the image forming apparatus 100.

The fixing unit 40 fixes the visible image onto the sheet by heating and pressurizing the sheet according to fixing conditions instructed by the control unit 70.

The storage unit 60 is configured with a storage device such as a magnetic hard disk device or a semiconductor storage device. The storage unit 60 functions as a sheet information storage unit 61. The sheet information storage unit 61 stores sheet information for each type of sheets. The sheet information is information relating to the physical characteristics of the sheet or information in which image forming information indicating the image forming conditions suitable for the sheet is defined for each type of sheets. In the following description, an example in which the sheet information is the image forming information will be described.

The image forming condition includes, for example, the transfer condition and the fixing condition. The transfer condition is an operation condition assumed to be suitable for performing the transfer to the sheet. The transfer condition is, for example, a value of a transfer voltage applied to a transfer roller. The fixing condition is an operation condition assumed to be suitable for performing the fixing to the sheet. The fixing condition includes a temperature (hereinafter, referred to as a "fixing temperature") of a fixing roller (not shown) and information (hereinafter, referred to as "conveyance information") relating to a time required for the sheet to pass through a nip portion. The conveyance information may be expressed as, for example, a conveying speed and a nip pressure.

The sheet information relating to the hybrid sheet 10 includes the image forming condition suitable for each of parts having different physical characteristics, a length of each part, and information (hereinafter, referred to as "arrival information") relating to a time required until processing is performed for each part. For example, the sheet information relating to the hybrid sheet 10 illustrated in FIG. 1 includes information relating to the first area 11 and information relating to the second area 12.

The information relating to the first area 11 indicates the image forming condition for the first area 11, the first area length, and a fact that the first area 11 is positioned at the top of the sheet in the conveying direction of the hybrid sheet 10. The arrival information relating to the first area 11 may be expressed as, for example, "0" centimeter. In this case, the control unit 70 calculates a time from when it is started to perform processing (transfer processing or fixing processing) for the hybrid sheet 10 to when the processing reaches the first area 11, by dividing the arrival information by the conveying speed at that time. The image forming condition relating to the first area 11 may be defined as, for example, transfer voltage V1 and a fixing temperature T1. In this case, the conveyance information may be defines as a constant value regardless of parts of the sheet.

The information relating to the second area 12 indicates the image forming condition relating to the second area 12, the second area length, and a fact that the second area 12 is positioned at a second position in the conveying direction of the hybrid sheet 10. The arrival information relating to the second area 12 may be expressed as, for example, "n" centimeter (n is the first area length). In this case, the control unit 70 calculates a time from when it is started to perform the processing (transfer processing or fixing processing) for the hybrid sheet 10 to when the processing reaches the second area 12, by dividing the arrival information by the conveying speed at that time. The image forming condition relating to the second area 12 may be defined as, for example, transfer voltage V2 and a fixing temperature T2. In this case, as described above, the conveyance information may be defined as a constant value regardless of parts of the sheet. In the example in FIG. 1, the respective values are defined as values having relationships of $V1<V2$ and $T1<T2$.

For example, in a case where the fixing temperature is constant regardless of parts of the sheet, the conveyance information may be defined as a value that varies according to a part. Specifically, in a case where the nip pressure is constant, the conveying speed in the first area 11 may be defined as S1 and the conveying speed in the second area 12 may be defined as S2. In this case, the respective values are defined as values having a relationship of S1>S2.

The control unit 70 functions as an image forming control unit 71, a transfer control unit 72, and a fixing control unit 73 by executing a program using a CPU.

The image forming control unit 71 controls the image forming processing on the sheet. The image forming control unit 71 performs processing such as conveyance of the sheet in the conveying path, image reading processing, image correction processing, the transfer processing, the fixing processing, and sheet discharge processing. When performing the transfer processing, the image forming control unit 71 instructs the transfer control unit 72 to control the transfer unit 20. When performing the fixing processing, the image forming control unit 71 instructs the fixing control unit 73 to control the fixing unit 40.

The transfer control unit 72 controls the operation of the transfer unit 20. For example, the transfer control unit 72 controls the transfer voltage value of the transfer unit 20 according to the sheet information of the image forming target sheet.

The fixing control unit 73 controls the operation of the fixing unit 40. For example, the fixing control unit 73 controls the fixing temperature at the fixing unit 40, the conveying speed, and the nip pressure according to the sheet information of the image forming target sheet.

Figure 4:
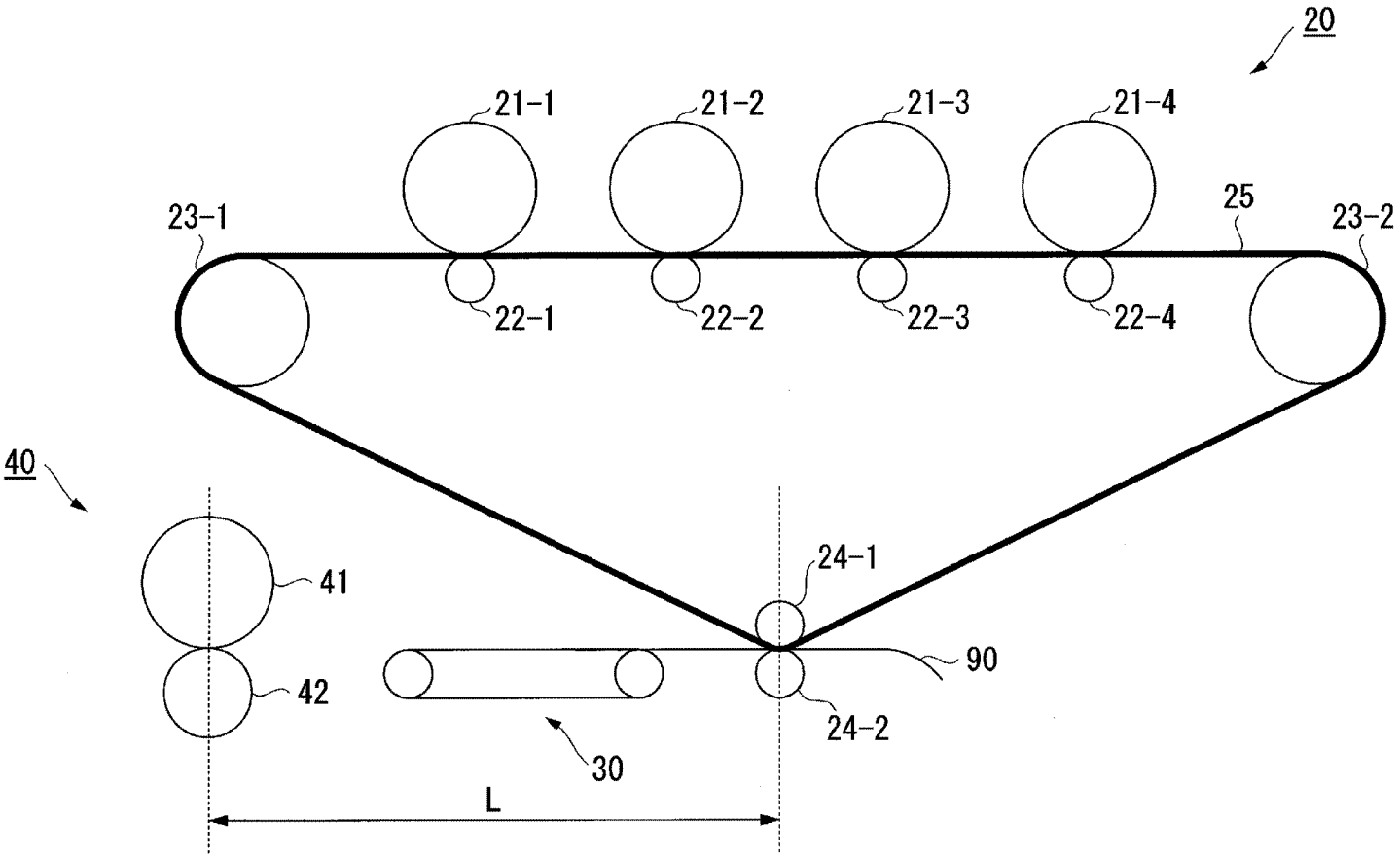
FIG. 4 is a diagram illustrating a specific example of a printer unit of the image forming apparatus.

FIG. 4 is a diagram illustrating a specific example of the printer unit 130 of the image forming apparatus 100. The printer unit 130 includes the transfer unit 20, an intermediate conveying unit 30, and the fixing unit 40.

The transfer unit 20 includes a plurality of photosensitive drums 21 (21-1, 21-2, 21-3, and 21-4), a plurality of primary transfer rollers 22 (22-1, 22-2, 22-3, and 22-4), a plurality of transfer conveying rollers 23 (23-1 and 23-2), secondary transfer rollers 24 (24-1 and 24-2), and a transfer belt 25. The plurality of photosensitive drums 21 forms toner images corresponding to colors allocated to the respective drums. The primary transfer rollers 22 transfer the toner images formed on the photosensitive drums 21, which are positioned opposite to the primary transfer rollers 22, onto the outer circumferential surface of the transfer belt 25. The transfer conveying rollers 23 rotates the transfer belt 25 in a predetermined direction at a predetermined speed. The secondary transfer rollers 24 transfer the toner image, which is transferred on the transfer belt 25, onto a sheet 90 which is subjected to the image forming process by being charged by the transfer control unit 72.

The intermediate conveying unit 30 conveys the sheet 90 on which the visible image is transferred by the transfer unit 20 to the fixing unit 40. It is desirable that a length "L" from a position where the sheet 90 is sandwiched between the secondary transfer rollers 24 to a position where the sheet 90 is sandwiched in the fixing unit 40 via the intermediate conveying unit 30 is greater than the length of the sheet 90 in the conveying direction.

The fixing unit 40 includes a heat roller 41 and a pressure roller 42. The heat roller 41 may include a heater therein. A temperature of the heater becomes the temperature controlled by the fixing control unit 73. The pressure roller 42 is pressed toward the heat roller 41 by a pressure portion (for example, a spring) (not illustrated). By applying this pressing force, the nip portion is formed between the heat roller 41 and the pressure roller 42.

Figure 5:
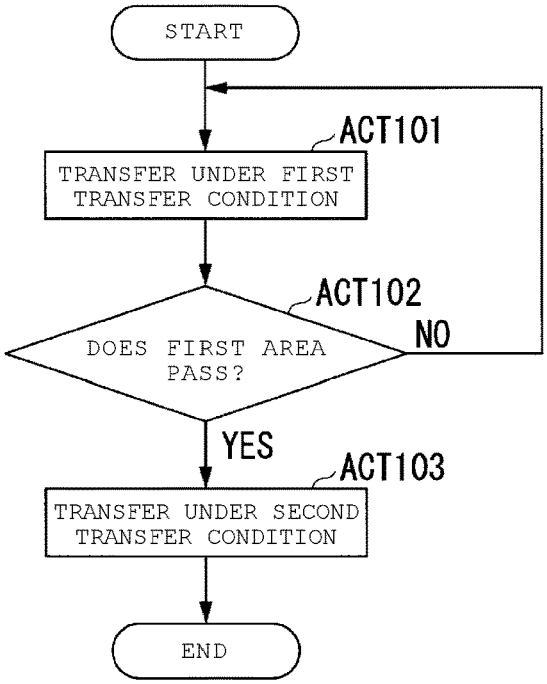
FIG. 5 is a flowchart depicting a flow of an operation of a transfer control unit in a case where an image forming target sheet is the hybrid sheet.

FIG. 5 is a flowchart depicting a flow of the operation of the transfer control unit 72 in a case where the sheet which is subjected to image forming process is the hybrid sheet 10. The transfer control unit 72 acquires the sheet information relating to the hybrid sheet 10 as an image forming target from the sheet information storage unit 61 in advance. The transfer control unit 72 determines a part which is a target of the first transfer processing based on the arrival information of each part. When the hybrid sheet 10 arrives at the transfer unit 20, the transfer control unit 72 starts the transfer under the transfer condition of the part which becomes the target of the first transfer processing. In the example of hybrid sheet 10 in FIG. 1, the transfer control unit 72 starts the transfer under the first transfer condition (ACT101).

Next, the transfer control unit 72 determines a part which is a target of the second transfer processing based on the arrival information of each part. In the example of the hybrid sheet 10 in FIG. 1, the part which is the target of the second transfer processing is the second area 12, and the transfer processing on the second area 12 starts after the hybrid sheet 10 is conveyed by the first area length. The transfer control unit 72 determines whether or not the first area 11 has completely passed through the transfer unit 20 (specifically, the position of the transfer unit 20 where the sheet is sandwiched between the secondary transfer rollers 24) based on the conveying speed of the sheet and the first area length (ACT102). The transfer control unit 72 continues the transfer processing under the first transfer condition until the first area 11 completely passes through the transfer unit (No in ACT102). On the other hand, if the first area 11 passes (Yes in ACT102), the transfer control unit 72 starts the transfer under a second transfer condition (ACT103). Thereafter, the transfer control unit 72 continues the transfer processing under the second transfer condition until the transfer to the hybrid sheet 10 is finished (in the example shown in FIG. 1, until the second area 12 completely passes through the position of the transfer unit 20 where the sheet is sandwiched between the secondary transfer rollers 24).

Figure 6:
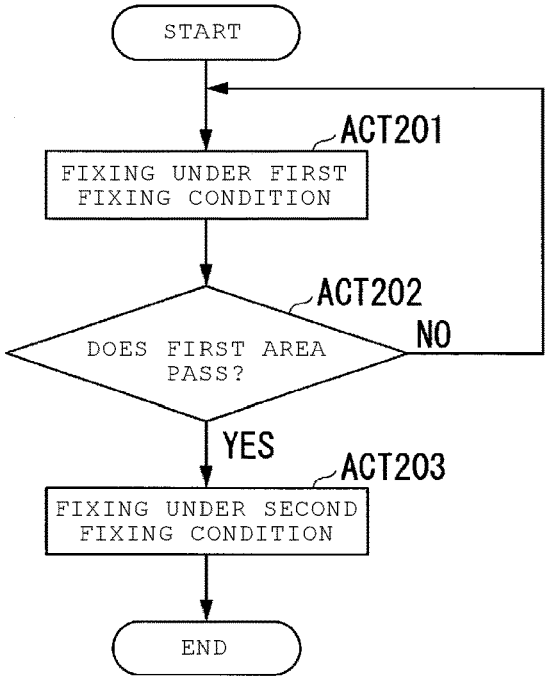
FIG. 6 is a flowchart depicting a flow of an operation of a fixing control unit in a case where an image forming target sheet is the hybrid sheet.

FIG. 6 is a flowchart depicting a flow of an operation of the fixing control unit 73 in a case where the image forming target sheet is the hybrid sheet 10. The fixing control unit 73 acquires the sheet information relating to the hybrid sheet 10 which is subjected to the image forming processing from the sheet information storage unit 61 in advance. The fixing control unit 73 determines a part which is the target of the first fixing processing based on the arrival information of each part. When the hybrid sheet 10 arrives at the nip portion of the fixing unit 40, the fixing control unit 73 starts the fixing under the fixing condition of the part which is first subjected to the fixing processing. In the example of the hybrid sheet 10 in FIG. 1, the fixing control unit 73 starts the fixing under the first fixing condition (ACT201).

Next, the fixing control unit 73 determines a part which is the target of the second fixing processing based on the arrival information of each part. In the example of the hybrid sheet 10 in FIG. 1, the part which is the target of the second fixing processing is the second area 12, and the fixing processing on the second area 12 starts after the hybrid sheet 10 is conveyed by the first area length. The fixing control unit 73 determines whether or not the first area 11 has passed through the fixing unit 40 (specifically, the position where the sheet is sandwiched by the fixing unit 40) based on the conveying speed of the sheet and the first area length (ACT202). The fixing control unit 73 continues the fixing processing under the first fixing condition until the first area 11 has passed through the nip portion of the fixing unit 40 (No in ACT202). On the other hand, if the first area 11 has passed through the nip portion (Yes in ACT202), the fixing control unit 73 starts the fixing under a second fixing condition (ACT203). Thereafter, the fixing control unit 73 continues the fixing processing under the second fixing condition until the fixing of the hybrid sheet 10 is finished (in the example shown in FIG. 1, until the second area 12 has passed through the nip portion).

As described above, the image forming apparatus 100 of the embodiment changes the transfer condition and the fixing condition during the image forming processing for a hybrid sheet 10. Therefore, it is possible to improve a quality of image forming process with respect to a sheet (hybrid sheet) having a plurality of parts of which physical characteristics such as a thicknesses or materials are different from each other. Specifically, the respective processings are performed under the transfer conditions and the fixing conditions corresponding to the respective areas at the timings when the transfer processing and the fixing processing are performed for the first area 11 and the second area 12 of the hybrid sheet 10. Therefore, it is possible to achieve the effect described above.

Modification Example

The sheet information may not be the image forming information indicating the image forming conditions suitable for the sheet as described above, but may be information relating to the physical characteristics of the sheet. For example, the sheet information may include information (the thickness and the material) relating to the physical characteristics of each of the parts of which the physical characteristics are different from each other, the lengths of the parts, and the arrival information of the parts. In this case, the transfer control unit 72 and the fixing control unit 73 of the image forming apparatus 100 is configured to acquire the transfer condition and the fixing condition in accordance with the thickness and the material of the image forming target sheet. For example, the storage unit 60 may be configured to store the transfer condition and the fixing condition suitable for each thickness and each material of a sheet in advance. In this case, the transfer control unit 72 and the fixing control unit 73 acquire the suitable transfer condition and the suitable fixing condition from the storage unit 60 according to the information relating to the physical characteristics of the sheet acquired from the sheet information storage unit 61.

The control unit 70 may be configured not to include the fixing control unit 73. In this case, in the image forming processing on the hybrid sheet 10, the image forming apparatus 100 performs the transfer processing on the first area 11 and the second area 12 under the transfer conditions corresponding to the respective areas. Even with this configuration, since the transfer processing corresponding to each area is performed, it is possible to improve the quality of image forming process.

The control unit 70 may be configured not to include the transfer control unit 72. In this case, in the image forming processing on the hybrid sheet 10, the image forming apparatus 100 performs the fixing processing on the first area 11 and the second area 12 under the fixing conditions corresponding to the respective areas. Even with this configuration, since the fixing corresponding to each area is performed, it is possible to improve the quality of image forming process.

In the example in FIG. 1, two areas of which the physical characteristics are different from each other are present on the hybrid sheet 10. Three or more areas of which the physical characteristics are different from each other may be present on the hybrid sheet 10 on which the image forming apparatus 100 forms images. In this case, each information relating to each area is stored in the sheet information storage unit 61.

Method for Acquiring Sheet Information

Hereinafter, a plurality of methods by which the image forming apparatus 100 acquires the sheet information will be described.

First, a first acquisition method will be described. The image forming apparatus 100 may acquire the sheet information which is stored in another information processing device in advance by receiving the information via a communication network. An example of another information processing device is a server provided by a supplier who supplies the sheet products (particularly, the hybrid sheet). Another example of another information processing device is an information processing device (a personal computer, a smart phone, or a tablet) used by a user using the image forming apparatus 100.

Next, a second acquisition method will be described. The image forming apparatus 100 may acquire the sheet information by reading an image provided in advance on a packing material that packs the sheet (particularly, the hybrid sheet). This image may be provided as, for example, a barcode or a two-dimensional barcode. In this case, the user registers the sheet information in the image forming apparatus 100 using a predetermined barcode reader. For example, the barcode reader may be connected to the image forming apparatus 100 or may be connected to another information processing device (for example, the personal computer, the smart phone, or the tablet). In addition, another information processing device may function as a barcode reader.

Next, a third acquisition method will be described. The image forming apparatus 100 may acquire the sheet information from a storage medium provided in advance on a packing material that packs the sheet (particularly, the hybrid sheet). This storage medium may be configured with, for example, an RFID tag. In this case, the user registers the sheet information in the image forming apparatus 100 using a predetermined RFID tag reader. For example, the RFID tag reader may be provided in the image forming apparatus 100, may be connected to the image forming apparatus 100, or may be connected to another information processing device (for example, the personal computer, the smart phone, or the tablet). In addition, another information processing device may function as the RFID tag reader.

Next, a fourth acquisition method will be described. The image forming apparatus 100 may acquire the sheet information by conveying the sheet without forming the image. Hereinafter, the fourth acquisition method will be described in detail.

The image forming apparatus 100 executing the fourth acquisition method performs an operation in an operation mode (hereinafter, referred to as an "adjustment mode") for acquiring the sheet information on the conveying path. In a case of operation in the adjustment mode, the transfer control unit 72 applies a transfer voltage or current value that is assumed to be suitable according to the conveying speed in advance to the secondary transfer roller 24 by a constant voltage or current control during a period from when at least the sheet enters the transfer unit 20 to when the sheet finishes to pass through the transfer unit 20. At this time, the transfer control unit 72 detects a temporal change of a voltage value in the secondary transfer roller 24 using a voltage measuring device (not illustrated).

Figure 7:
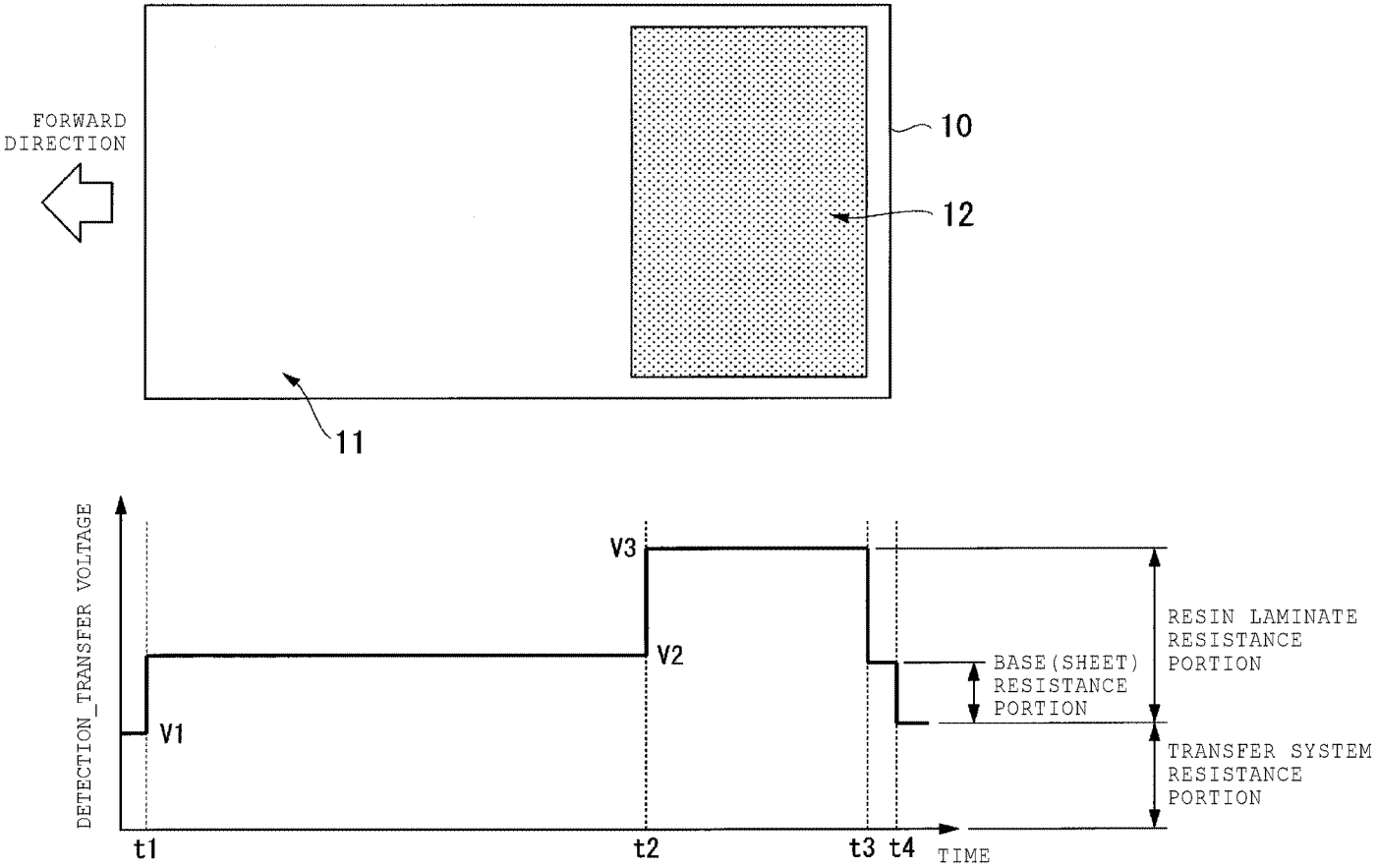
FIG. 7 is a diagram illustrating a specific example of a change in voltage value at each point on the hybrid sheet.

FIG. 7 is a diagram illustrating a specific example of a change in voltage value at each point on the hybrid sheet 10. A voltage value v1 before time t1 is a voltage value in a state in which the sheet is not sandwiched between the secondary transfer rollers 24. The voltage value v2 between time t2 and time t3 is a voltage value in a state in which the first area 11 of the hybrid sheet 10 is sandwiched between the secondary transfer rollers 24. The voltage value v3 between time t3 and time t4 is a voltage value in a state in which the second area 12 of the hybrid sheet 10 is sandwiched between the secondary transfer rollers 24. By measuring the voltage values in the respective areas as described above, the transfer control unit determines the transfer conditions suitable for the respective areas. The transfer control unit 72 may determine the length of each area according to the conveying speed and the timing of the change of the voltage value. The transfer control unit 72 may register the sheet information obtained as described above in the sheet information storage unit 61.

Figure 8:
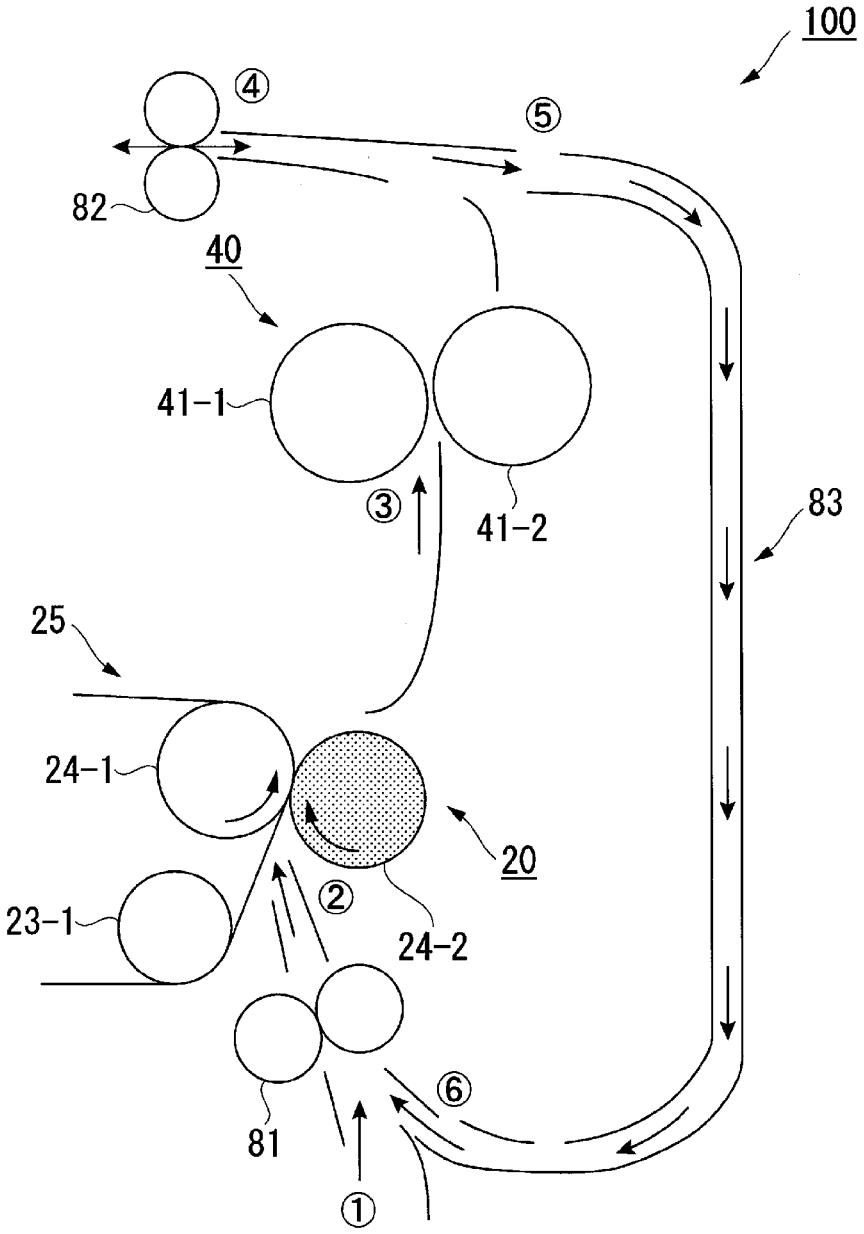
FIG. 8 is a diagram illustrating a specific example of the image forming apparatus.
Figure 9:
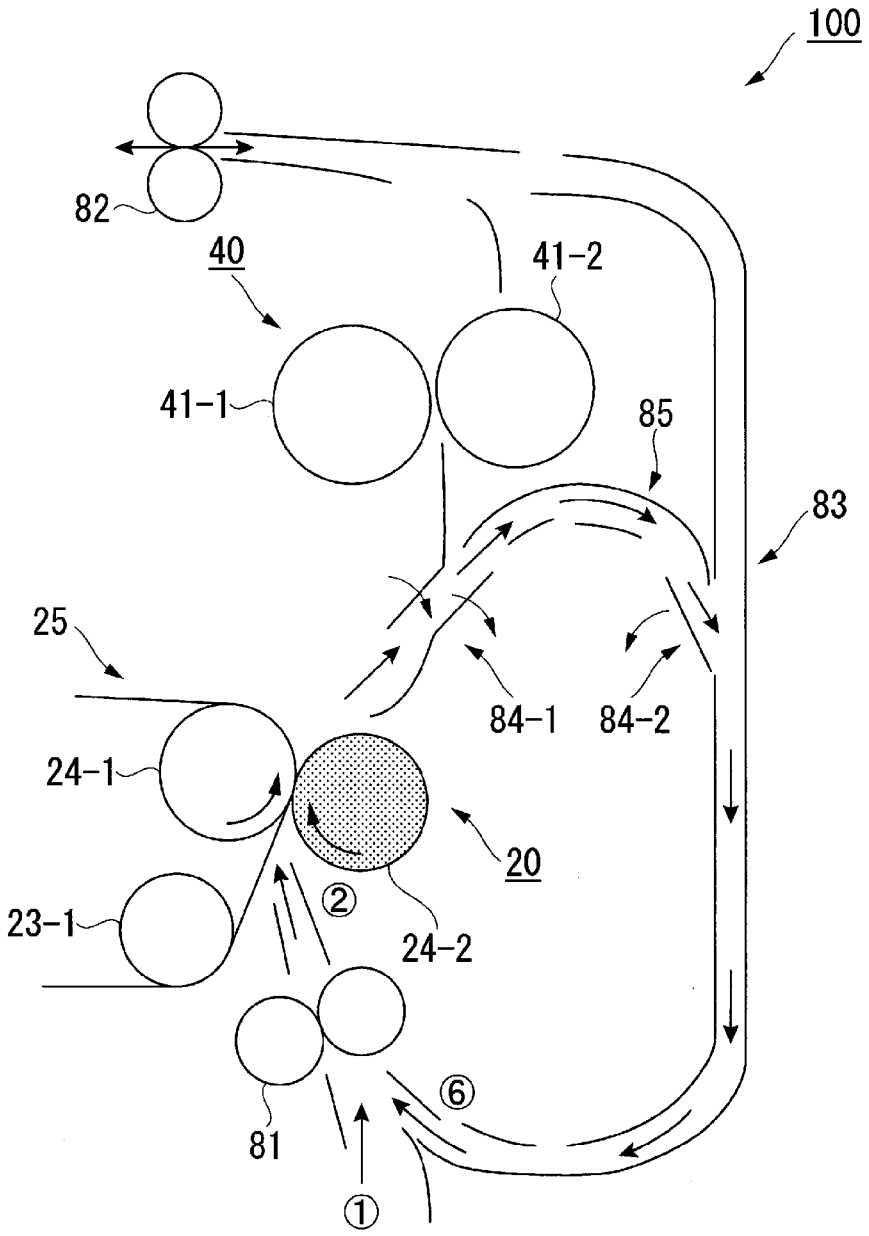
FIG. 9 is a diagram illustrating a specific example of the image forming apparatus.

When the sheet is conveyed along the conveying path in this adjustment mode, if the temperature of the fixing unit 40 is controlled at a temperature same as that at the time of image forming process, the sheet is heated. In this case, moisture contained in the sheet is vaporized, and it is concerned that the physical characteristics of the sheet might be changed. FIG. 8 and FIG. 9 are diagrams illustrating specific examples of the image forming apparatus 100 having means for solving such a problem.

In FIG. 8, the image forming apparatus 100 includes a duplex printing conveying path 83 that connects from a part forward of a sheet discharge roller 82 to an aligning roller 81. In the adjustment mode, the sheet which passed through the fixing unit 40 returns to the aligning roller 81 via the duplex printing conveying path 83. When the sheet is conveyed along this path in the adjustment mode, the fixing control unit 73 controls the temperature of the fixing unit 40 to be lower than that at the time of image forming process. For example, the fixing unit 40 may be controlled such that the heater is in off state. Then, the control unit 70 changes the mode from the adjustment mode to a mode for performing image forming process, and performs image forming process on the sheet that arrives at the aligning roller 81 after passing through the duplex printing conveying path 83. By performing the above-described processing, it is possible to prevent the sheet from being heated at a temperature same as that at the time of image forming process and the physical characteristics from being changed. Therefore, it is possible to perform the appropriate image forming process on the sheet used in the adjustment mode based on the value measured in the adjustment mode.

In FIG. 9, the image forming apparatus 100 includes drive branch guides 84-1 and 84-2 between the transfer unit 20 and the fixing unit 40. In addition, the image forming apparatus 100 includes a return guide 85. The image forming control unit 71 conveys the sheet that passes through the transfer unit 20 not to the fixing unit 40 but to the return guide 85 by driving the drive branch guides 84-1 and 84-2 in the operation in the adjustment mode. The sheet conveyed to the return guide 85 is conveyed to the duplex printing conveying path 83 via the return guide 85, and arrives at the aligning roller 81. Then, the control unit 70 changes the mode from the adjustment mode to the mode for performing image forming process, and performs image forming process on the sheet that arrives at the aligning roller 81. Since the above-described processing does not pass the sheet through the fixing unit 40, it is possible to prevent the sheet from being heated and the physical characteristics from being changed. Therefore, it is possible to perform the appropriate image forming process on the sheet used in the adjustment mode based on the value measured in the adjustment mode.

As described above, four detailed examples of sheet information acquisition methods are described. However, the sheet information may be acquired by the image forming apparatus 100 using another method.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus comprising:

an image transfer roller configured to transfer an image formed on an image carrier to a sheet, according to a transfer control parameter; and a controller configured to:

during an adjustment mode during which no image is formed on the image carrier, cause a constant current to be applied to the image transfer roller while the sheet passes through the image transfer roller and measure a voltage of the image transfer roller using a voltage measuring device as the sheet passes through the image transfer roller, to detect a first area and a second area of the sheet; and during an image forming mode, set the transfer control parameter to a first value when a first portion of the image is being transferred to the first area of the sheet and to a second value when a second portion of the image is being transferred to the second area of the sheet.

2. The image forming apparatus according to claim 1, wherein the transfer control parameter is a value of a voltage applied to the image transfer roller.

3. The image forming apparatus according to claim 1, wherein the first value and the second value are determined based on the measured voltages.

4. The image forming apparatus according to claim 1, further comprising:

an image fixing roller configured to fix the image on the sheet, according to a fixing control parameter, wherein the controller is configured to set, during the image forming mode, the fixing control parameter to a third value when the image fixing roller fixes the first portion of the image on the first area of the sheet and to a fourth value when the image fixing roller fixes the second portion of the image on the second area of the sheet.

5. The image forming apparatus according to claim 4, wherein the fixing control parameter is a fixing temperature, a sheet conveyance speed through the image fixing roller, or both.

6. The image forming apparatus according to claim 4, wherein the third value and the fourth value are a temperature of the image fixing roller, and the controller is further configured to set, during the adjustment mode, the temperature of the image fixing roller to a fifth value lower than the third value and the fourth value.

7. The image forming apparatus according to claim 4, wherein the controller is further configured to turn off heating of the image fixing roller during the adjustment mode.

8. The image forming apparatus according to claim 4, wherein the controller is further configured to change a sheet conveyance path during the adjustment mode, such that the sheet returns toward the image transfer roller without passing the image fixing roller.

9. The image forming apparatus according to claim 1, wherein the first area of the sheet and the second area of the sheet have different thicknesses.

10. The image forming apparatus according to claim 1, wherein the first area of the sheet and the second area of the sheet are at least partially formed with different materials.

11. The image forming apparatus according to claim 10, wherein the first area of the sheet contains no resin coating, and the second area of the sheet contains a resin coating.

12. The image forming apparatus according to claim 10, wherein the first area of the sheet contains no adhesion layer, and the second area of the sheet contains an adhesion layer.

* * * * *